US006263765B1

(12) United States Patent
McCamley

(10) Patent No.: US 6,263,765 B1
(45) Date of Patent: Jul. 24, 2001

(54) OPEN-ENDED WRENCH

(76) Inventor: Jeffrey D. McCamley, P.O. Box 10421 Calder Sq., State College, PA (US) 16805

( * ) Notice: Subject to any disclaimer, the term of this patent is extended or adjusted under 35 U.S.C. 154(b) by 117 days.

(21) Appl. No.: 08/949,917

(22) Filed: Oct. 14, 1997

(51) Int. Cl.[7] ..... B25B 13/00
(52) U.S. Cl. ..... 81/58; 81/60
(58) Field of Search ..... 81/58, 58.8, 58.5, 81/60

(56) References Cited

U.S. PATENT DOCUMENTS

| | | | | |
|---|---|---|---|---|
| 556,151 | | 3/1896 | Johnson . | |
| 735,134 | | 8/1903 | McLean . | |
| 923,942 | | 6/1909 | Brockway . | |
| 935,807 | | 10/1909 | Oswald . | |
| 1,115,532 | * | 11/1914 | Harlan | 81/58.2 X |
| 1,258,382 | * | 3/1918 | Webb | 81/58.5 |
| 1,265,823 | | 5/1918 | Skjonsbye . | |
| 1,541,065 | | 6/1925 | Olson . | |
| 1,890,213 | | 12/1932 | Cameron et al. . | |
| 2,527,033 | | 10/1950 | Rodgers et al. . | |
| 2,757,564 | * | 8/1956 | Reaves | 81/58.2 |
| 2,758,493 | * | 8/1956 | Goldwater | 81/58.2 |
| 2,954,715 | | 10/1960 | Wycech . | |
| 5,113,726 | * | 5/1992 | Etheridge | 81/60 |
| 5,277,087 | * | 1/1994 | Wilson et al. | 81/58.2 X |

FOREIGN PATENT DOCUMENTS

| | | | | |
|---|---|---|---|---|
| 24953 | * | 10/1909 | (GB) | 81/58.2 |

* cited by examiner

*Primary Examiner*—James G. Smith
(74) *Attorney, Agent, or Firm*—Parsons & Goltry; Robert A. Parsons; Michael W. Goltry

(57) ABSTRACT

A wrench including a framework having substantially coextensive first and second arms mounted for pivotal movement at a proximal end and extending outwardly therefrom and terminating with opposed arcuate jaws, and a wrench head assembly including a plurality of wrench head segments mountable in continuous series for rotation with the jaws and movable from a closed wrench head orientation to an open wrench head orientation in response to movement of the arms to define a gap intermediate adjacent ones of the plurality of wrench head segments carried adjacent the respective free ends of the jaws and of an extent sufficient to admit a member to be rotated, and from the open wrench head orientation of the plurality of wrench head segments to the closed wrench head orientation in response to movement of the arms to engage the member to be rotated.

23 Claims, 3 Drawing Sheets

OPEN-ENDED WRENCH

BACKGROUND OF THE INVENTION

1. Field of the Invention

This invention relates generally to the field of tools. More particularly, this invention relates to tools of a type commonly employed for engaging bolts, nuts and other similar items desired to be rotated.

In a further and more specific aspect, the instant invention relates to a wrench having an end movable between an open position for receiving a member such as a bolt or a nut and a closed position for engaging the member for facilitating the grasping and/or rotation of the member.

2. Prior Art

A wrench is normally defined as a hand or power tool for holding, twisting or turning objects such as nuts and bolts. The prior art is replete with wrenches suitable for grasping, twisting or rotating nuts and bolts. Common wrench designs include crescent wrenches, socket wrenches and open and box wrenches. Although exemplary for facilitating rotation of nuts, bolts and other similar items, ratcheting movement socket wrenches are among the most popular with workmen and workwomen. In this regard, the socket of a conventional ratchet style wrench may be conveniently placed about a nut or a bolt and then rotated by virtue of reciprocating movement of the ratchet style wrench to rotate the nut or bolt in a predetermined direction. Furthermore, a ratcheting or pawl mechanism may be adjusted for facilitating rotation of the socket in a predetermined and selected direction.

Unlike ratchet style socket wrenches, crescent wrenches and other open-ended wrenches have proven utility in approaching a nut or a bolt from a laterally directed position when the space above the nut or bolt is insufficient to allow a user to insert a socket over the nut or bolt. Furthermore, to rotate a nut or bolt with a crescent or other variety of open-ended wrench in the foregoing environment may require a user to repeatedly engage, rotate and disengage the crescent or other open-ended wrench from the nut or bolt when in a constrictive environment or when access to the not or bolt is otherwise restricted. Repeatedly engaging, rotating and disengaging a nut or bolt in the foregoing manner is not only time consuming and inefficient, but also normally frustrating for the user.

It would be highly advantageous, therefore, to remedy the foregoing and other deficiencies inherent in the prior art.

Accordingly, it is an object of the present invention to provide a wrench having a wrench head assembly movable from an open wrench head orientation for facilitating lateral receipt of a member such as a nut or bolt, and a closed wrench head orientation for engaging the member for rotation.

Another object of the present invention is to provide a wrench that is easy to use.

And another object of the present invention is to provide a wrench that is convenient to use.

Still another object of the present invention is to provide a wrench that is easy to construct.

Yet another object of the instant invention is to provide a wrench that is inexpensive.

Yet still another object of the instant invention is to provide a wrench that incorporates not only a wrench head assembly movable from an open wrench head orientation for facilitating lateral receipt of a bolt or nut, and a closed wrench head orientation for engaging the bolt or nut for rotation, but also a pawl mechanism for advantageously facilitating ratcheting movement of the wrench head assembly.

And a further object of the invention is the provision of eliminating frustration commonly experienced by users using crescent and other similar open-ended wrenches.

Still a further object of the immediate invention is to provide a wrench that is efficient.

SUMMARY OF THE INVENTION

Briefly, to achieve the desired objects of the instant invention in accordance with a preferred embodiment thereof, provided is a wrench including a framework having substantially coextensive first and second arms mounted for pivotal movement at a proximal end and extending outwardly therefrom and terminating with opposed arcuate jaws each terminating with a free end. The framework is movable from a closed position of the jaws traversing diverging lateral pivotal movement of the arms to an open position of the jaws, and the open position of the jaws traversing converging lateral pivotal movement of the arms to the closed position of the jaws.

The wrench may further include a plurality of wrench head segments mountable in continuous series for rotation with the jaws and movable from an aligned configuration of the plurality of wrench head segments in a closed wrench head orientation to an open wrench head orientation in response to movement of the arms to the open position of the jaws to define a gap intermediate adjacent ones of the plurality of wrench head segments positioned or otherwise carried adjacent the respective free ends of the jaws and of an extent sufficient to admit therethrough from a direction from the free ends of the jaws a member to be rotated. The plurality of wrench head segments are also movable from the open wrench head orientation to the closed wrench head orientation in response to movement of the arms to the closed position of the jaws to engage the member to be rotated, each of the plurality of wrench head segments including an engagement surface each cooperating together to define a substantially continuous engagement surface in the closed wrench head orientation adapted to generally conform and engage the member to be rotated in the closed wrench head orientation.

In a particular embodiment of the present invention, the plurality of wrench head segments may include three wrench head segments each having an engagement surface such that when in the closed wrench head orientation of the wrench head assembly, define a substantially continuous engagement surface adapted for engaging a member to be rotated in the closed wrench head orientation of the wrench head assembly. Each one of the plurality of wrench head segments may further include an outer surface having interdental spaces formed therealong, wherein in the closed wrench head orientation of the plurality of wrench head segments, the outer surface of each of the plurality of wrench head segments define an outer circumference. A pawl assembly may also be provided carried by the framework proximate the jaws and adapted to fall within the interdental spaces for permitting rotational movement of the wrench head assembly relative the jaws in the closed wrench head orientation in one or more predetermined rotational directions.

In another embodiment of the present invention, each one of the jaws of the framework may include an arcuate channel having a pair of diametrically opposed arcuate tongues extending inwardly into the arcuate channel from opposed inner surfaces bounding the channel, each one of the arcuate tongues terminating with opposed spaced apart free ends. Consistent therewith, each one of the plurality of wrench head segments may correspondingly include a pair of opposed arcuate grooves, each one of the plurality of wrench head segments adapted for sliding receipt into the channel of each one of the jaws with each one of the pair of diametrically opposed tongues being slidably receivable into and through a respective one of the grooves. A pair of bearings carried by the framework may also be provided each receivable within one of the grooves of each of the plurality of wrench head segments, the pair of bearings operative for facilitating smooth rotational movement of the wrench head segments within the channels of the jaws in the closed wrench head orientation of the plurality of wrench head segments.

In another embodiment, each one of the plurality of wrench head segments may include at least one mark visible through an aperture formed though the framework proximate one of the jaws at a point relative the channel of at least one of the jaws for facilitating visual access into the channel of one of the jaws, wherein placement of one of the marks of a selected one of the plurality of wrench head segments relative the aperture corresponds to the aligned configuration of the plurality of wrench head segments.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which.

DETAILED DESCRIPTION OF THE PREFERRED EMBODIMENTS

Figure 1:
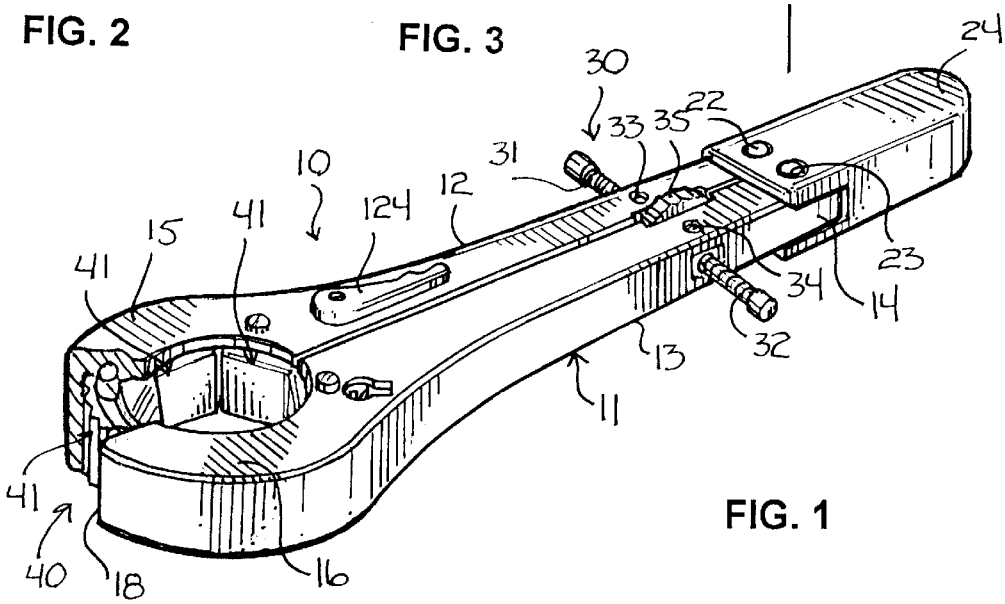
FIG. 1 illustrates a perspective view of a wrench including a wrench head having a plurality of wrench head segments mounted for rotation to a framework, in accordance with a preferred embodiment of the present invention.
Figure 6:
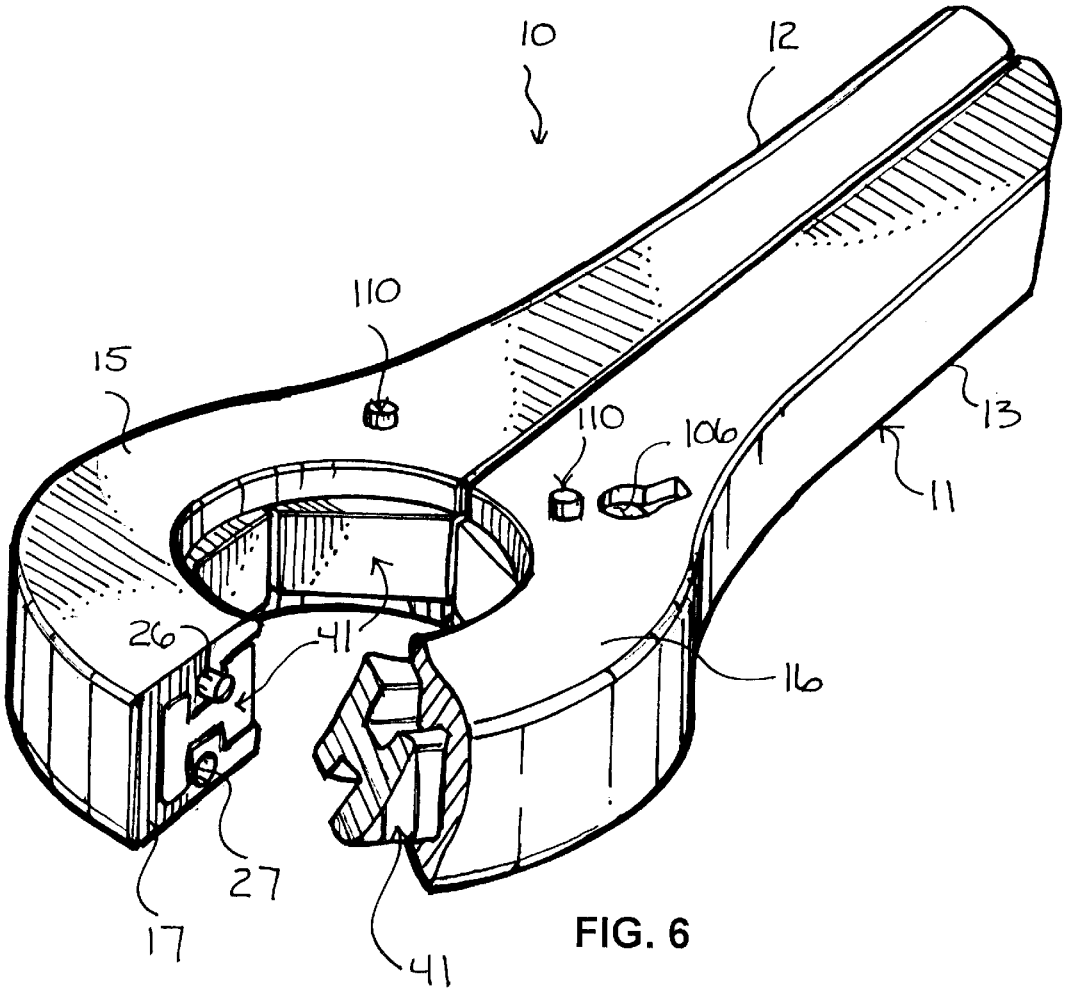
FIG. 6 illustrates a view very similar to the view of FIG. 5.

Turning now to the drawings, in which like reference characters indicate corresponding elements throughout the several views, attention is first directed to FIG. 1 illustrating a perspective view of a wrench 10 constructed in accordance with a preferred embodiment of the present invention. Wrench 10 is preferably, although not essentially, a hand held apparatus comprised of a framework 11 including substantially coextensive first and second arms 12 and 13 mounted for pivotal movement at a proximal end 14 and extending outwardly therefrom and terminating with opposed arcuate jaws 15 and 16 each terminating with a free end 17 (shown only in FIG. 2 and FIG. 6) and 18, respectively. In a further and more particular aspect, and with attention directed to FIG. 3 illustrating a top plan view of the wrench of FIG. 1, arms 12 and 13 each further include an inner end 20 and 21 opposite jaws 15 and 16, respectively, mounted for pivotal movement at proximal end 14 by virtue of pivot pins 22 and 23, respectively, to a handle 24 constructed of a size sufficient to be grasp by a human hand.

Figure 2:
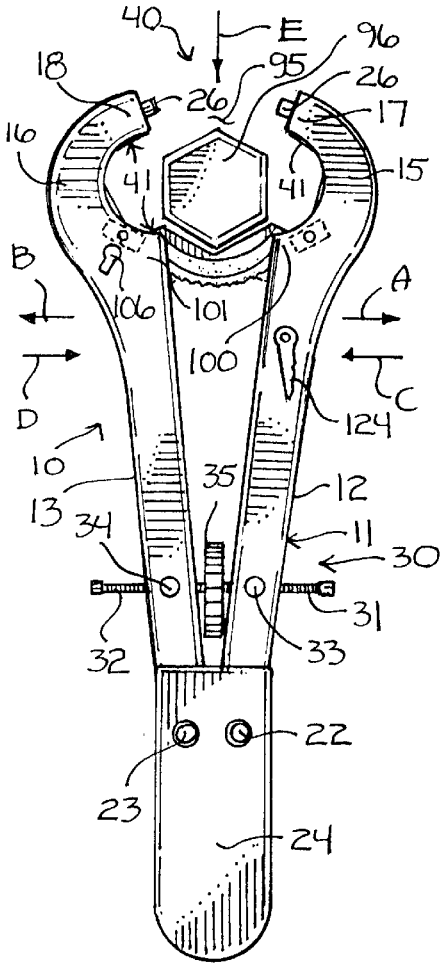
FIG. 2 is a top plan view of the wrench of FIG. 1 illustrating the wrench head as it would appear in an open wrench head orientation, in accordance with a preferred embodiment of the present invention.

Framework 11 is movable from a closed position of jaws 15 and 16 as shown in FIG. 1 traversing diverging lateral pivotal movement of arms 12 and 13 about proximal end 14 in the directions indicated by the arrowed lines A and B, respectively, in FIG. 2 to an open position of jaws 15 and 16, and the open position of jaws 15 and 16 traversing converging lateral pivotal movement of arms 12 and 13 about proximal end 14 in the directions indicated by the arrowed lines C and D, respectively, to the closed position of jaws 15 and 16. Although a variety of mechanical mechanisms may be employed for facilitating movement of arms along diverging and converging pivotal traverse about proximal end 14, FIG. 1, FIG. 2 and FIG. 3 illustrate an actuating assembly 30 carried by arms 12 and 13 of framework 11 proximate proximal end 14.

Actuating assembly 30 includes a pair of elongate threaded elements 31 and 32 mounted transversely relative arms 12 and 13 through threaded pivot pins 33 and 34 mounted within apertures of arms 12 and 13, respectively, and fixedly mounted to a wheel 35 positioned intermediate arms 12 and 13. Regarding a preferred embodiment of the present invention, elongate threaded elements 31 and 32 are preferably threaded in opposite directions such that upon rotation of wheel in one and another predetermined directions, such as by hand, arms 12 and 13 will pivot about proximal end 14 in outwardly divergent pivotal traverse and inwardly convergent pivotal traverse, respectively. Furthermore, threaded pivot pins 33 and 34 facilitate pivotal movement about their respective axes and relative arms 12 and 13 as arms 12 and 13 are moved either in diverging or converging pivotal traverse upon actuation of actuating assembly 30.

Figure 3:
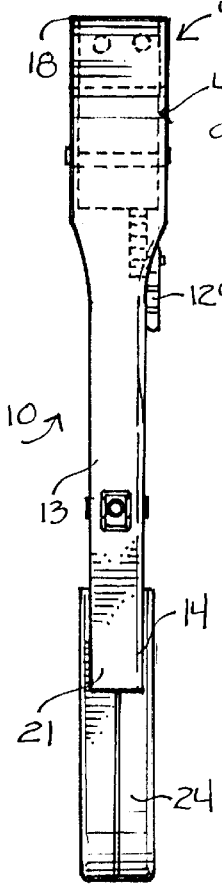
FIG. 3 is a side elevational view of the wrench of FIG. 1.
Figure 4:
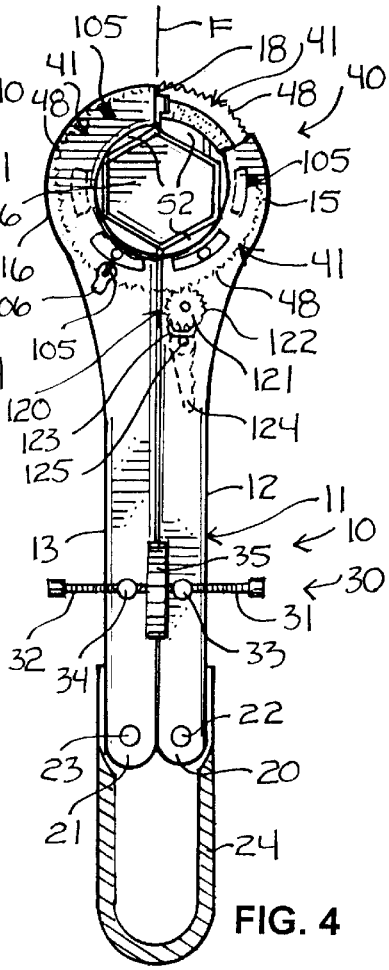
FIG. 4 is a top plan view of the wrench of FIG. 1 illustrating the wrench head as it would appear in a closed wrench head orientation with portions of the framework broken away for the purposes of illustration, in accordance with a preferred embodiment of the present invention.
Figure 5:
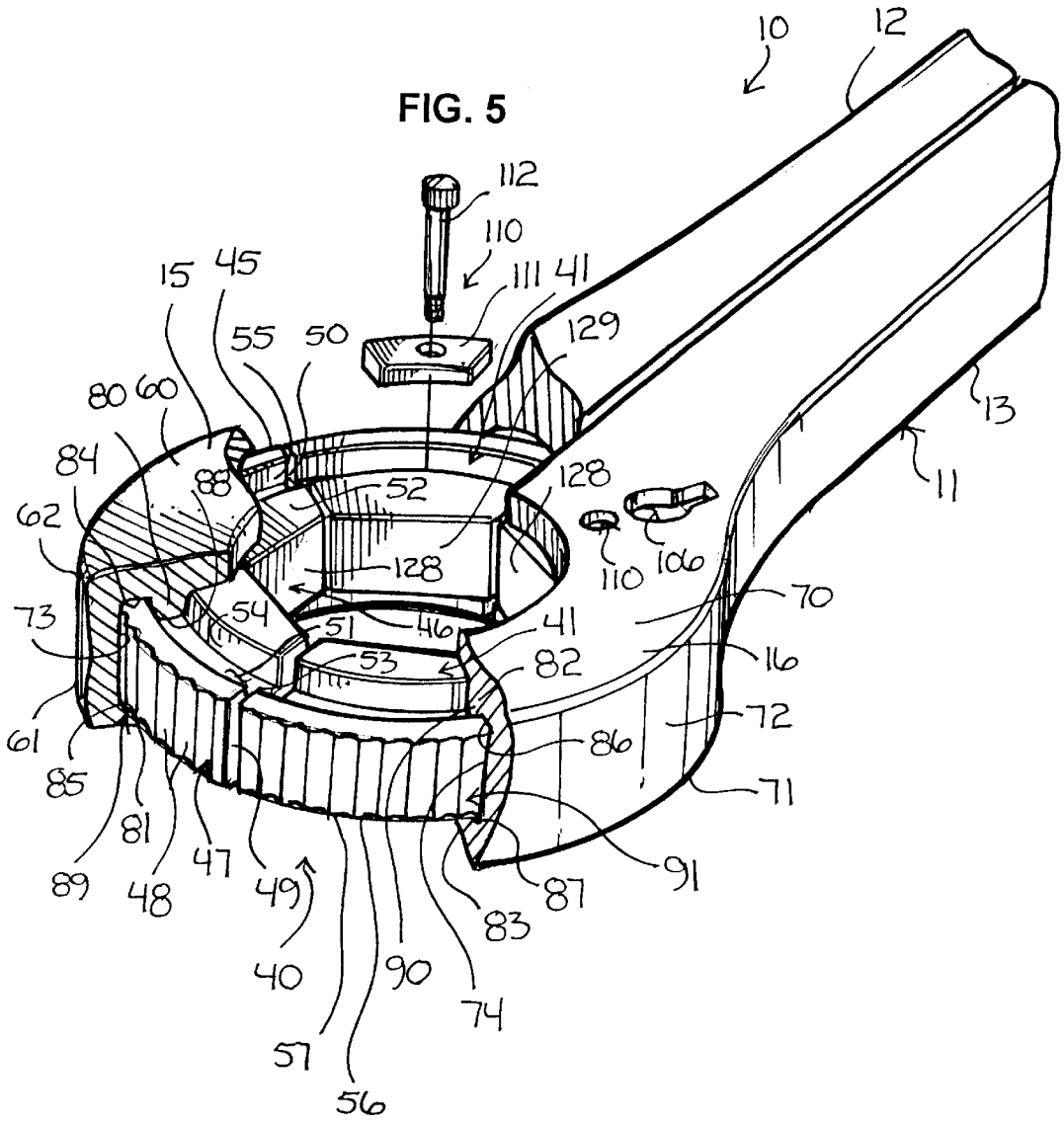
FIG. 5 is an enlarged fragmented perspective view of the wrench of FIG. 1 illustrating the wrench head assembly carried by opposed arcuate jaws of the framework of the wrench, with portions of one of the jaws broken away for the purposes of illustration.

With continuing reference to FIG. 1, FIG. 2, FIG. 4 and additional reference to FIG. 3 illustrating a side elevational view of the wrench of FIG. 1, wrench 10 further includes a wrench head assembly 40 having a plurality of wrench head segments, each designated by the reference character 41, mountable in continuous series for rotation with jaws 15 and 16. With attention directed specifically to FIG. 5 illustrating an enlarged fragmented perspective view of wrench 10 with wrench head assembly 40 carried by arcuate jaws 15 and 16 of framework 11 with portions of jaw 15 broken away for the purposes of illustration, wrench head segments 41 are each substantially identical. In this regard, each wrench head segment 41 includes a body 45 having an engagement surface 46 an outer surface 47 having a plurality of teeth or interdental spaces 48 formed therealong, and opposite free ends 49 and 50. Having a substantially crescent or arcuate shape, outer surface 47 of each wrench head segment 41 is correspondingly substantially arcuate. Furthermore, body 45 of each wrench head segment 41 includes a substantially arcuate groove 51 formed through an upper surface 52, each groove 51 being bound and defined by a floor 53 and opposed side surfaces 54 and 55 extending outwardly from floor 53 toward upper surface 52. Being a mirror image of itself along its axial cross section, body 45 of each wrench head segment further includes another substantially arcuate groove 56 formed through a lower surface 57 thereof being the mirror image of substantially arcuate groove 51.

With continuing reference to FIG. 5, jaws 15 and 16 each include opposed sidewalls 60 and 61, and 70 and 71, and an endwall 62 and 72 cooperating together to bound an arcuate channel 73 and 74, respectively. Being the mirror image of the other, each respective sidewall 60 and 61, and 70 and 71 includes a pair of diametrically opposed arcuate tongues 80 and 81, and 82 and 83, extending inwardly into a respective one of arcuate channels 73 and 74 from opposed inner surfaces 84 and 85, and 86 and 87, of sidewalls 60 and 61, and 70 and 71 bounding a respective channel 73 and 74, arcuate tongues 80 and 81, and 82 and 83, each terminating with opposed spaced apart free ends 88 and 89, and 90 and 91, respectively. Having an arcuate shape consistent with the arcuate shape of each channel 73 and 74, and grooves 51 and 56 being of a size and shape sufficient to slidably receive one of the respective tongues 80, 81, 82 and 83, each wrench head segment is suitably adapted to be slidably and rotatably receivable or mounted into and through channels 73 and 74 of framework 11 in continuous series as shown in FIG. 1, FIG. 3, FIG. 4 and FIG. 5.

Upon placement of each wrench head segment 41 of wrench head assembly into channels 73 and 74 of framework 11 in the foregoing manner, wrench head segments 41 are movable from an aligned configuration, to be herein presently discussed, of wrench head segments 41 in a closed wrench head orientation as shown in FIG. 1, FIG. 4 and FIG. 5 to an open wrench head orientation as shown in FIG. 2 in response to movement of arms to the open position of jaws 15 and 16 to define a gap 95 intermediate adjacent ones of wrench head segments 41 carried adjacent the respective free ends 17 and 18 of jaws 15 and 16 with one of the wrench head segments 41 shown bridging lower ends 100 and 101 of jaws 15 and 16 opposite free ends 17 and 18. As shown in FIG. 2, gap 95 is preferably sized of an extent sufficient to admit therethrough, in a direction from free ends 17 and 18 of framework 11 as indicated by the arrowed line E, a member 96 to be rotated. Furthermore, from the open wrench head orientation of wrench head segments 41, wrench head segments 41 are also movable to the closed wrench head orientation in response to movement of arms 12 and 13 to the closed position of jaws 15 and 16. In the closed wrench head orientation of wrench head segments 41, wrench head segments 41 are disposed in continuous series thereby defining a box wrench head configuration with the engagement surface 46 of each wrench head segment 41 cooperating together to define a substantially continuous engagement surface. Consistent with the desired teachings of the present invention, the substantially continuous engagement surface of wrench head assembly 40 as defined in the closed wrench head orientation of wrench head segments 41 is suitable adapted to generally conform and engage member 96 to be rotated, of which may be a bolt, nut or other object desired to be grasp and/or rotated.

As previously intimated, to suitable dispose wrench head segments into the open wrench head orientation as shown in FIG. 2 and as specifically defined herein, wrench head segments 41 must be first disposed, while in the closed wrench head orientation, into the aligned configuration of the wrench head segments 41. In the aligned configuration of wrench head segments 41 as evidenced in FIG. 4, a wrench head segment 41 is shown terminating at a respective free end 17 and 18 of jaws 15 and 16 each wrench head segment 41 terminating with an opposing free end 49 and 50, respectively, at a point substantially contiguous with longitudinal axis F of framework 11 of wrench 10. In this aligned orientation of wrench head segments 41 as herein specifically defined, movement of wrench head segments 41 into the open wrench head orientation in the manner previously discussed results in the orientation of wrench head segments 41 in the open wrench head orientation as previously discussed and shown in FIG. 2.

To facilitate the desired movement of wrench head segments 41 into the aligned configuration as shown in FIG. 4, one or more of wrench head segments 41 may each include at least one mark 105 (shown only in FIG. 4) suitably and desirably disposed at a predetermined and desired location upon upper surface 52 thereof and visible through an aperture 106 (shown in FIG. 1, FIG. 2, FIG. 3 and FIG. 5) formed though framework 11 proximate at least one of jaws 15 and 16 at a point relative a respective channel 73 and/or 74. In this regard, rotation of wrench head assembly 40 relative jaws 15 and 16 for placement of mark 105 of a selected one of wrench head segments 41 relative aperture 106 may desirably correspond to the aligned configuration of wrench head segments 41 thereby facilitating the ease of aligning wrench head segments 41 into the aligned configuration. Regarding FIG. 5, and for facilitating smooth rotational movement of wrench head assembly 40 within and through channels 73 and 74 of jaws 15 and 16 in the closed wrench head orientation, wrench 10 may further include a pair of bearings elements, only one shown and each generally designated by the reference character 110. Each bearing element 110 includes a bearing 111 pivotally mounted via a pivot pin 112 to framework 11 proximate a respective one of jaws 15 and 16 and receivable within each groove 51 of each of wrench head segment 41. Consistent with the desired teachings of the present invention, although bearing elements 110 have been herein discussed as mounted to framework for receipt with groove 51 of each wrench head segment 41, bearing elements 110 may also or alternatively be mounted to framework 11 for receipt within groove 56 of each wrench head segment 41 without departing from the nature and scope of the present invention as herein specifically described. Furthermore, the pivotal mount of bearing 111 facilitates movement of wrench head segments 41 from the closed wrench head orientation to the open wrench head orientation without causing bearing 111 to bind within grooves 51 of adjacent wrench head segments which would otherwise inhibit movement of wrench head segments 41 from the closed wrench head orientation to the open wrench head orientation.

With momentary reference to FIG. 4, wrench 10 may further include a pawl assembly 120 carried by framework 11 proximate jaws 15 and 16 operative for facilitating a predetermined and selected direction of rotation of wrench head assembly 40 in the closed wrench head orientation for allowing a user to rotate member 96 in a predetermined and selected rotational direction. Consistent with conventional ratchet-style socket wrenches replete within the art and well known to those having ordinary skill, pawl assembly includes a pinion 121 mounted with framework 11 for rotation and having teeth 122 formed about an outer perimeter thereof and adapted to fall within interdental spaces 48 of each wrench head segment 41, the outer surface 47 of each wrench head segments 41 cooperating together to define an outer circumference of wrench head assembly 40 in the closed wrench head orientation. Pawl assembly 120 further includes an armature 123 mounted to a lever 124 correspondingly mounted to framework 11 by virtue of a pin 125 for facilitating pivotal reciprocating movement of lever 124. In this regard, and consistent with convention pawl assembly mechanisms, lever 124 may be adjusted for facilitating selected engagement of armature 123 with teeth 122 of pinion 121 for permitting rotational movement of wrench head assembly 40 relative jaws 15 and 16 in the closed wrench head orientation in one or more predetermined rotational directions. It will be readily understood that other mechanical architectures may be used in lieu of pawl assembly 120 operative for desirably introducing ratcheting-style rotational movement of wrench head assembly 40 relative jaws 15 and 16 in the closed wrench head orientation without departing from the nature and scope of the present invention as herein specifically described.

From the foregoing discussion, it will be readily understood that wrench head assembly 40 may be desirably moved from the open wrench head orientation for allowing the admittance of a member to be rotated through gap 95 formed intermediate adjacent wrench head segments 41. In this regard, a user may desirably approach and engage a member to be rotated with wrench head assembly 40 from a lateral direction. Once moved to the closed wrench head orientation for facilitating engagement of the member to be rotated by the substantially continuous engagement surface of wrench head assembly 40 in the closed wrench head orientation defined herein as a box orientation of wrench head assembly 40, a user may enjoy not only the benefit of a box head wrench orientation, but also the desired and efficient ratcheting movement of wrench head assembly 40 relative jaws 15 and 16 for facilitating easy and efficient rotation of the member to be rotated in a predetermined and desired direction through reciprocating movement of framework 11. Furthermore, to facilitate engagement of a member by continuous engagement surface of wrench head assembly 40 in the closed wrench head orientation, and with attention directed to FIG. 5, engagement surface 46 of each wrench head segment 41 may include a pair of opposed diverging surfaces 128 and 129 that, when the plurality of wrench head segments 41 includes three wrench head segments 41, may cooperate together to define a hexagonal engagement surface of the substantially continuous engagement surface of wrench head assembly 40 in the closed wrench head orientation of wrench head segments 41 operative for desirably engaging the hexagonal engagement surface of conventional bolts and nuts such as member 96 shown in FIG. 2 and FIG. 4.

The present invention has been described above with reference to a preferred embodiment. However, those skilled in the art will recognize that changes and modifications may be made in the described embodiments without departing from the nature and scope of the present invention. For instance, although a preferred embodiment of the present invention include the plurality of wrench head segments 41 as three, less than or more than three wrench head segments 41 may suitably be used consistent with the teachings herein without departing from the nature and scope of the present invention as herein specifically described. Furthermore, arcuate jaws 15 and 16 are preferably but not essentially constructed of a size such that in the closed wrench head orientation, free ends 17 and 18 of arcuate jaws 15 and 16 engage one another. To facilitate the engagement and alignment of free ends 17 and 18 in this regard, each free end 17 and 18 may be provided with an engagement element 26 (FIG. 2 and FIG. 6) and a spaced-apart complemental engagement element 27 (shown only in FIG. 6), the engagement element 26 of each respective free end 17 and 18 being opposed from and detachably engagable with a corresponding complemental engagement element 27. Each engagement element 26 and complemental engagement element 27 are preferably but not essentially comprised of a pin and a groove, respectively, although other suitable constructs may be used consistent with the teachings herein.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A wrench, comprising:

a framework including substantially coextensive first and second arms mounted for pivotal movement at a proximal end and extending outwardly therefrom and terminating with opposed arcuate jaws each terminating with a free end, said framework movable from a closed position of said jaws to an open position of said jaws; and a plurality of wrench head segments mountable in continuous series for rotation with said jaws and movable from an aligned configuration of said plurality of wrench head segments in a closed wrench head orientation to an open wrench head orientation in response to movement of said arms to the open position of said jaws to define a gap intermediate adjacent ones of said plurality of wrench head segments carried adjacent the respective said free ends of said jaws and of an extent sufficient to admit therethrough from a direction from said free ends of said jaws a member to be rotated, and from the open wrench head orientation of said plurality of wrench head segments to the closed wrench head orientation in response to movement of said arms to the closed position of said jaws to engage the member to be rotated, each of said plurality of wrench head segments including an engagement surface each cooperating together to define a substantially continuous engagement surface in the closed wrench head orientation adapted to generally conform and engage the member to be rotated in the closed wrench head orientation.

2. The wrench of claim 1, wherein said substantially coextensive first and second arms are mounted for pivotal movement at said proximal end to a handle of said framework of a size sufficient to be grasp by a human hand.

3. The wrench of claim 1, further including means for moving the arms along diverging lateral pivotal traverse and along converging lateral pivotal traverse.

4. The wrench of claim 1, wherein said plurality of wrench head segments include three wrench head segments.

5. The wrench of claim 4, wherein said engagement surface of each one of said three wrench head segments includes a pair of opposed diverging surfaces which cooperate together to define a hexagonal engagement surface of said substantially continuous engagement surface in the closed wrench head orientation of said plurality of wrench head segments.

6. The wrench of claim 1, further including:

a pawl assembly carried by said framework proximate said jaws; and each one of said plurality of wrench head segments further including an outer surface having interdental spaces formed therealong, wherein in the closed wrench head orientation of said plurality of wrench head segments said outer surface of each of said plurality of wrench head segments cooperate together to define an outer circumference, said pawl assembly adapted to fall within said interdental spaces along the outer circumference of said wrench head assembly for permitting rotational movement of said wrench head assembly relative said jaws in the closed wrench head orientation in one or more predetermined and selected rotational directions.

7. The wrench of claim 1, wherein:

each one of said jaws further includes an arcuate channel having a pair of diametrically opposed arcuate tongues extending inwardly into said arcuate channel from opposed inner surfaces bounding said channel, each one of said arcuate tongues terminating with opposed spaced apart free ends; and each one of said plurality of wrench head segments further including a pair of opposed arcuate grooves, each one of said plurality of wrench head segments adapted for sliding receipt into said channel of each one of said jaws with each one of said pair of diametrically opposed tongues being slidably receivable into and through a respective one of said grooves.

8. The wrench of claim 7, further including a plurality of bearings, each one of said plurality of bearings pivotally mounted proximate a respective one of said jaws and receivable within one of said grooves of each of said plurality of wrench head segments, said plurality of bearings operative for facilitating smooth rotational movement of said wrench head segments within said channels of said jaws in the closed wrench head orientation of said plurality of wrench head segments.

9. The wrench of claim 7, wherein each one of said plurality of wrench head segments further includes at least one mark visible through an aperture formed though said framework proximate one of said jaws at a point relative said channel of one of said jaws for facilitating visual access into said channel of one of said jaws, wherein placement of one of said marks of a selected one of said plurality of wrench head segments relative said aperture corresponds to said aligned configuration of said plurality of wrench head segments.

10. For use with a framework of a type including substantially coextensive first and second arms mounted for pivotal movement at a proximal end and extending outwardly therefrom and terminating with opposed arcuate jaws each terminating with a free end, the framework movable from a closed position of the jaws to an open position of the jaws, a wrench head assembly, comprising:

a plurality of wrench head segments mountable in continuous series for rotation with the jaws and movable from an aligned configuration of said plurality of wrench head segments in a closed wrench head orientation to an open wrench head orientation in response to movement of the arms to the open position of the jaws to define a gap intermediate adjacent ones of said plurality of wrench head segments carried adjacent the respective free ends of the jaws of an extent sufficient to admit therethrough from a direction from the free ends of the jaws a member to be rotated, and from the open wrench head orientation of said plurality of wrench head segments to the closed wrench head orientation in response to movement of the arms to the closed position of the jaws to engage the member to be rotated, each of said plurality of wrench head segments including an engagement surface each cooperating together to define a substantially continuous engagement surface in the closed wrench head orientation adapted to generally conform and engage the member to be rotated in the closed wrench head orientation.

11. The wrench head assembly of claim 10, wherein said plurality of wrench head segments include three wrench head segments.

12. The wrench head assembly of claim 11, wherein said engagement surface of each of said three wrench head segments includes a pair of opposed diverging surfaces which cooperate together to define a hexagonal engagement surface of said substantially continuous engagement surface of said wrench head assembly in the closed wrench head orientation of said plurality of wrench head segments.

13. The wrench head assembly of claim 10, the framework having a pawl assembly carried by the framework proximate the jaws, wherein:

each one of said plurality of wrench head segments further includes an outer surface having interdental spaces formed therealong, wherein in the closed wrench head orientation of said plurality of wrench head segments said outer surface of each of said plurality of wrench head segments cooperate together to define an outer circumference, the pawl assembly adapted to fall within said interdental spaces along the outer circumference of said wrench head assembly for permitting rotational movement of said wrench head assembly relative the jaws in the closed wrench head orientation in one or more predetermined and selected rotational directions.

14. The wrench head assembly of claim 10, each one of the jaws of the framework having an arcuate channel with a pair of diametrically opposed arcuate tongues extending inwardly into the arcuate channel from opposed inner surfaces bounding the channel, each one of the arcuate tongues terminating with opposed spaced apart free ends, wherein:

each one of said plurality of wrench head segments further includes a pair of opposed arcuate grooves, each one of said plurality of wrench head segments adapted for sliding receipt into the channel of each one of the jaws with each one of the pair of diametrically opposed tongues being slidably receivable into and through a respective one of said grooves.

15. The wrench head assembly of claim 14, the framework having a plurality of bearings pivotally mounted proximate a respective one of the jaws, wherein:

at least one of said grooves of each of said plurality of wrench head segments is adapted to slidably receive each one of the bearings of the framework, the plurality of bearings operative for facilitating smooth rotational movement of said wrench head segments within the channels of the jaws in the closed wrench head orientation of said wrench head assembly.

16. The wrench head assembly of claim 14, the framework having an aperture formed though the framework proximate one of the jaws at a point relative the channel of at least one of the jaws for facilitating visual access into the channel of one of the jaws, wherein:

each one of said plurality of wrench head segments further includes at least one mark visible through the aperture, wherein placement of one of said marks of a selected one of said plurality of wrench head segments relative the aperture corresponds to said aligned configuration of said plurality of wrench head segments.

17. For use with a wrench head assembly of a type having a plurality of wrench head segments each having an engagement surface, the plurality of wrench head segments movable between an open wrench head orientation and a closed wrench head orientation in continuous series, the engagement surface of each one of the plurality of wrench head segments cooperating together to define a substantially continuous engagement surface of the wrench head assembly in the closed wrench head orientation adapted to generally conform and engage a member to be rotated, a framework, comprising:

substantially coextensive first and second arms mounted for pivotal movement at a proximal end and extending outwardly therefrom and terminating with opposed arcuate jaws each terminating with a free end, said framework movable from a closed position of said jaws to an open position of said jaws;

wherein the plurality of wrench head segments are mountable in continuous series for rotation with said jaws and movable from an aligned configuration of the plurality of wrench head segments in the closed wrench head orientation to the open wrench head orientation in response to movement of said arms to the open position of said jaws to define a gap intermediate adjacent ones of the plurality of wrench head segments carried adjacent the respective said free ends of said jaws of an extent sufficient to admit therethrough from a direction from said free ends of said jaws the member to be rotated, and from the open wrench head orientation of the plurality of wrench head segments to the closed wrench head orientation in response to movement of said arms to the closed position of said jaws to facilitate engagement of the member to be rotated by the substantially continuous engagement surface of the wrench head assembly in the closed wrench head orientation.

18. The framework of claim 17, wherein said substantially coextensive first and second arms are mounted for pivotal movement at said proximal end to a handle of said framework of a size sufficient to be grasp by a human hand.

19. The framework of claim 17, further including means for moving said arms along diverging lateral pivotal traverse and along converging lateral pivotal traverse.

20. The framework of claim 17, each one of the plurality of wrench head segments having an outer surface with interdental spaces formed therealong, wherein in the closed wrench head orientation of the plurality of wrench head segments the outer surface of each of the plurality of wrench head segments cooperate together to define an outer circumference, further including:

a pawl assembly carried by said framework proximate said jaws and adapted to fall within the interdental spaces for permitting rotational movement of the wrench head assembly relative said jaws in the closed wrench head orientation in one or more predetermined rotational directions.

21. The framework of claim 17, each one of the plurality of wrench head segments having a pair of opposed arcuate grooves, further including:

each one of said jaws having an arcuate channel with a pair of diametrically opposed arcuate tongues extending inwardly into said arcuate channel from opposed inner surfaces bounding said channel, each one of said arcuate tongues terminating with opposed spaced apart free ends;

wherein each one of said channels is adapted for slidably receiving said plurality of wrench head segments, each one of said pair of diametrically opposed tongues being constructed of a size sufficient to be slidably receivable into and through a respective one of the grooves.

22. The framework of claim 21, further including a plurality of bearings, each one of said plurality of bearings pivotally mounted proximate a respective one of said jaws and receivable within one of the grooves of each of the plurality of wrench head segments, said plurality of bearings operative for facilitating smooth rotational movement of the wrench head segments within said arcuate channels of said jaws in the closed wrench head orientation of the wrench head assembly.

23. The framework of claim 21, each one of the plurality of wrench head segments having at least one mark disposed thereon, further including:

an aperture formed though said framework proximate at least one of said jaws at a point relative said arcuate channel of one of said jaws for facilitating visual access into said channel of one of said jaws;

wherein placement of one of the marks of a selected one of the plurality of wrench head segments relative said aperture corresponds to the aligned configuration of the plurality of wrench head segments relative said jaws of said framework.

* * * * *